United States Patent [19]

Parsons et al.

[11] Patent Number: 4,827,493

[45] Date of Patent: May 2, 1989

[54] RADIOGRAPHIC SOURCE

[75] Inventors: George W. Parsons, North Reading, Mass.; Robert L. Kelly, Hudson, N.H.; Joseph M. Zlotnicki, Methuen, Mass.

[73] Assignee: Amersham Corporation, Burlington, Mass.

[21] Appl. No.: 104,687

[22] Filed: Oct. 5, 1987

[51] Int. Cl.[4] ..... G21G 4/00

[52] U.S. Cl. ..... 378/119; 378/65; 250/493.1; 252/644; 252/645

[58] Field of Search ..... 378/119, 65, 64, 120; 250/493.1, 496.1, 308; 252/644, 645

[56] References Cited

U.S. PATENT DOCUMENTS

| | | | |
|---|---|---|---|
| 3,351,049 | 11/1967 | Lawrence | 252/644 |
| 3,376,422 | 4/1968 | Haes | 252/644 |
| 3,664,083 | 5/1972 | Fradin et al. | 252/644 |
| 3,866,050 | 2/1975 | Whitfield | 378/65 |

*Primary Examiner*—Carolyn E. Fields
*Assistant Examiner*—Joseph A. Hynds
*Attorney, Agent, or Firm*—Wolf, Greenfield & Sacks

[57] ABSTRACT

A radiography source, preferably a cobalt-60 source constructed of a plurality of radioactive cobalt-60 pellets contained in an open capsule preferably constructed of titanium. The pellets are disposed in the capsule and compacted therein to reduce the source focal size. A plug is disposed in the open capsule and welded therewith. The cobalt and titanium materials are sufficiently different in atomic number to permit good X-ray analysis resolution.

18 Claims, 3 Drawing Sheets

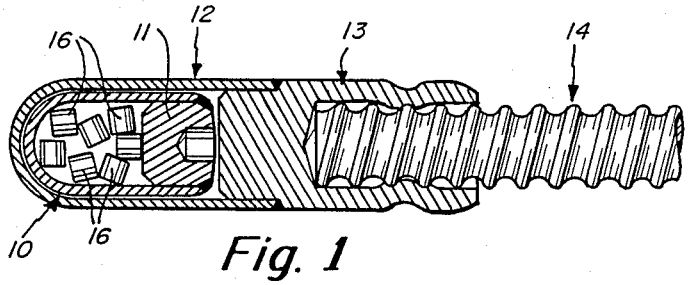
Fig. 1
(PRIOR ART)
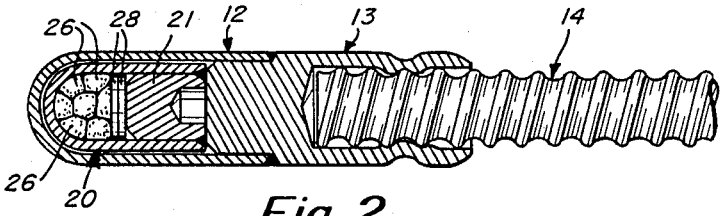
Fig. 2
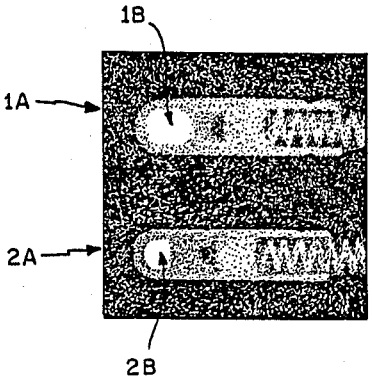
Fig. 3
Fig. 4
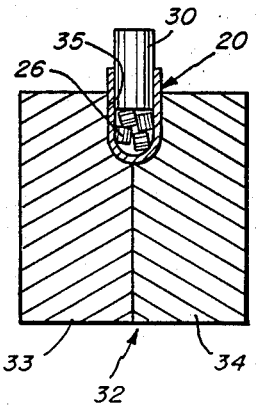
Fig. 5
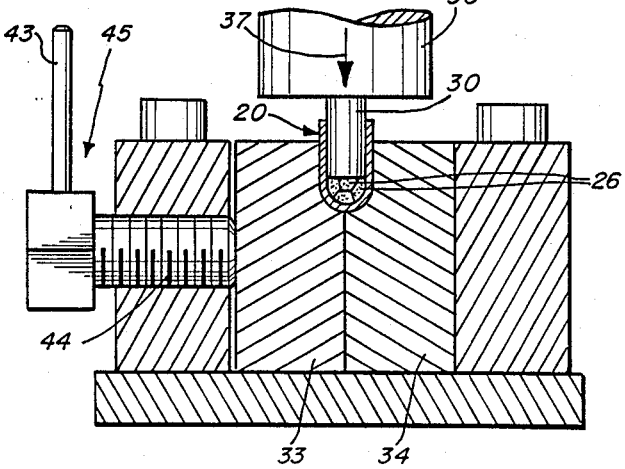

Fig. 6
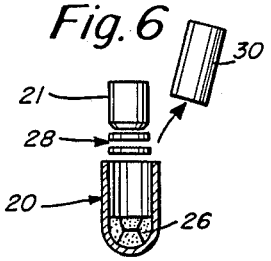
Fig. 7
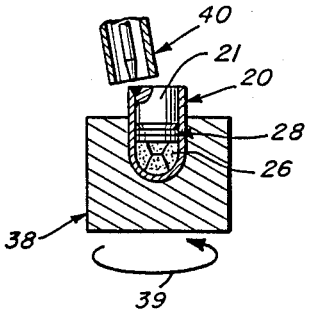
Fig. 8
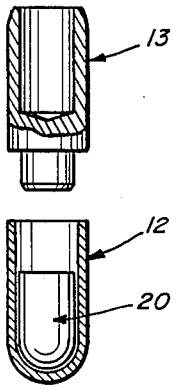
Fig. 9
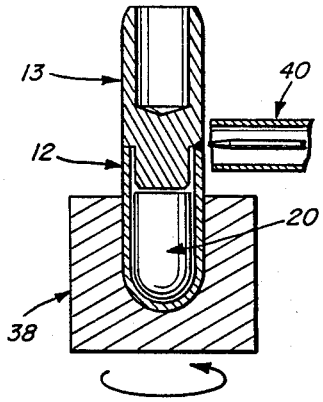
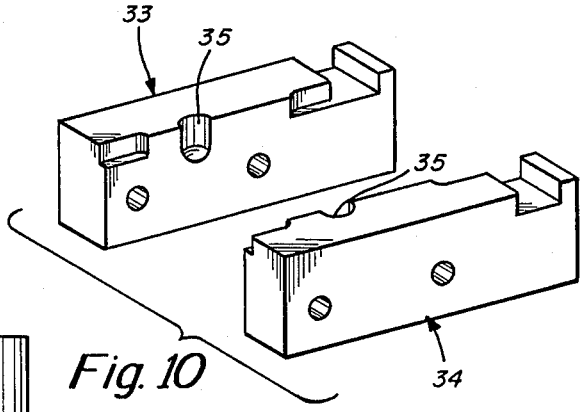
Fig. 10
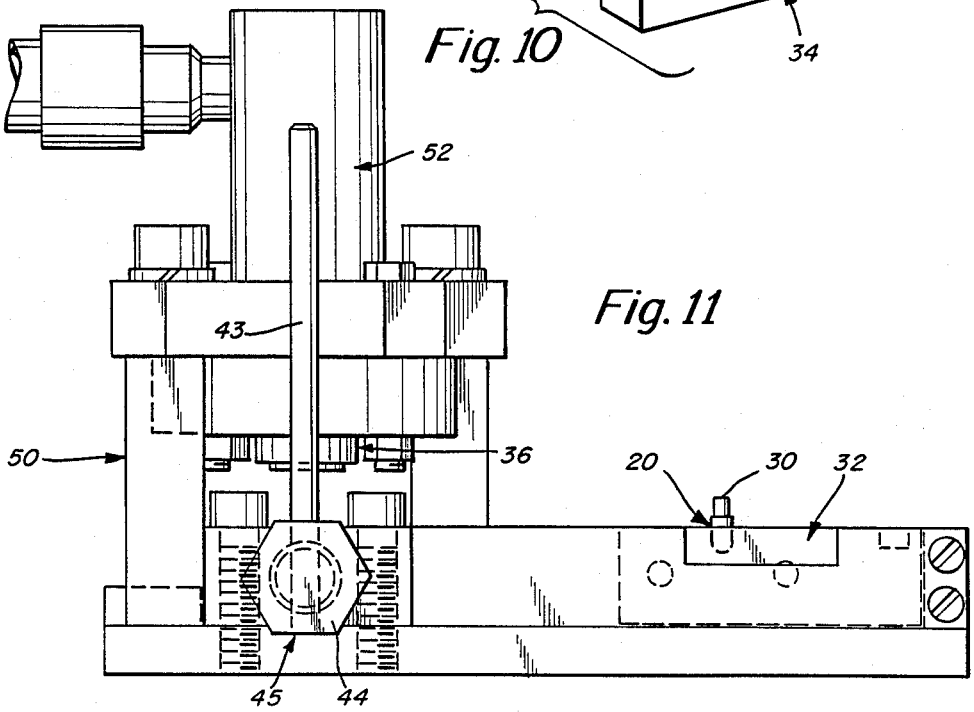
Fig. 11

Fig. 12
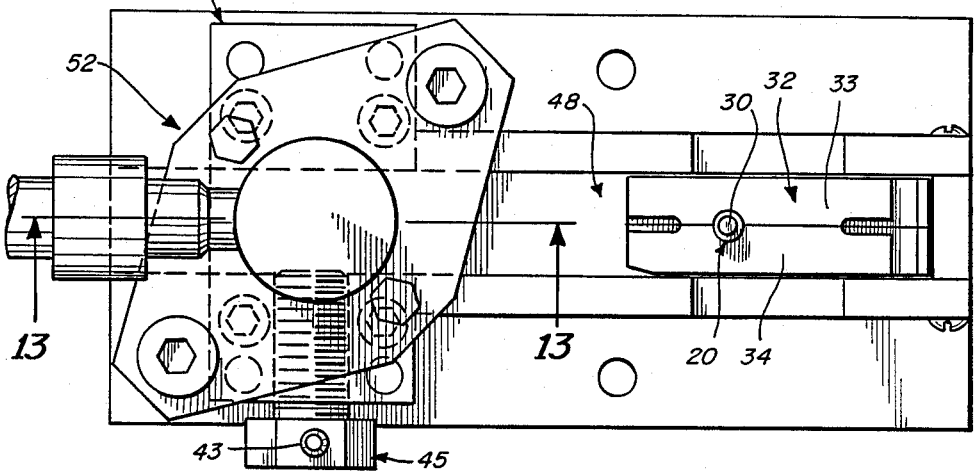
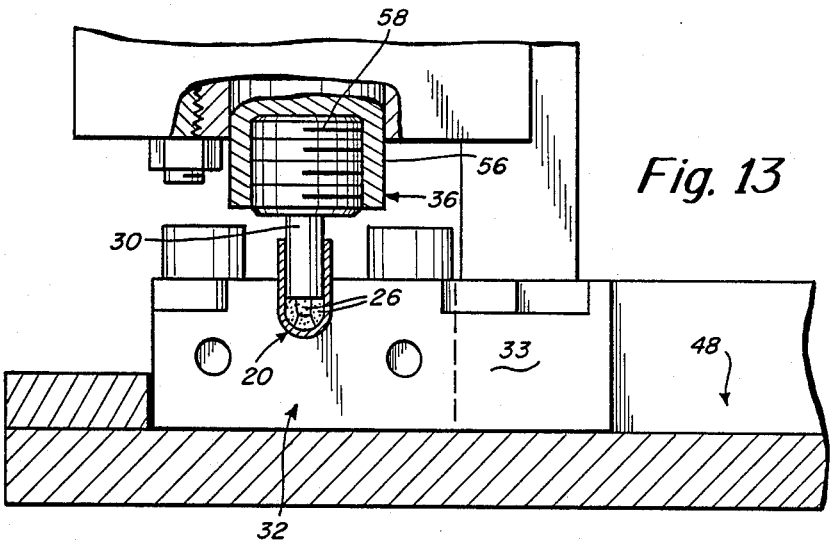
Fig. 13

RADIOGRAPHIC SOURCE

BACKGROUND OF THE INVENTION

1. Field of the Invention

The present invention relates in general to a radiographic source and an associated method of making a radiographic source. The radiographic source and the associated method of making thereof are described herein in connection with the manufacture of a cobalt-60 radiographic source. The present invention also relates to a new technique for the accurate measurement of focal spot size for in particular cobalt-60 radiographic sources.

2. Background Discussion

Radiographic sources are presently known and are constructed with the use of such radioactive materials as cobalt-60 and iridium-192. A cobalt-60 radiographic source presently manufactured by the assignee herein is constructed of inner and outer stainless steel capsules with the inner capsule containing a plurality of cobalt-60 pellets; the number of cobalt-60 pellets being the function of the source size. The inner capsule is seal welded by a plug or cover also of stainless steel.

In the past attempts have been made to compact the cobalt-60 pellets. However, the compaction has not been totally effective. The techniques used to date have caused deformation of the capsule to the extent that the inner capsule could not be inserted into the outer capsule.

Accordingly, one object of the present invention is to provide an improved method of making a radiographic source in which the source radioactive material is effectively compacted so as to provide an actual effective density as high as 90% of the density of the cobalt metal. It is to be noted that this improved radiographic material compression provides a considerably higher activity in a smaller focal spot size, resulting in substantial money savings in radiography exposure time alone.

With the presently employed stainless steel inner capsule there has always been some inherent factors that yielded uncertainty over the exact focal spot size provided. There was a statistical error relating to the cobalt pellet orientation at the edges of the focal spot (edge effects). There is also distortion of the focal spot due to ineffective compression. There was uncertainty over void volume due to the ineffective compression. There was also a statistical error from the cobalt-60 specific activity which is measured before encapsulation. While the contribution from each of these factors may be only a few percent, they are additive when calculating the overall uncertainty.

The smallest focal spot size has been in demand by the industry in general for many years. However, actual verification of focal spot size has been virtually impossible due to the fact that cobalt and steel have very similar atomic numbers (cobalt=27, steel=26) and a very similar density (cobalt=8.9 gm/cc, steel=7.9 gm/cc ). This means that it is extremely difficult to separate these materials by x-ray analysis.

Accordingly, it is another object of the present invention to provide an improved radiography source and associated method of manufacture with the inner capsule construction of a material that enables adequate film contrast by x-ray radiography between the inner capsule and the radioactive material.

A further object of the present invention is to provide an improved technique for in particular accurately measuring the focal spot size for a radiographic source and for in particular a cobalt-60 radiographic source.

Still another object of the present invention is to provide an improved apparatus for compacting radioactive pellets and for particularly compacting cobalt-60 pellets in a capsule.

Still a further object of the present invention is to provide the improved apparatus as recited in the preceding object and in which the capsule is constructed of a material that has a sufficiently different atomic number in comparison to the radioactive material so that adequate film contrast by x-ray radiography can be achieve while at the same time constructing the capsule of a material with sufficient tensile strength so as to assist in preventing deformation thereof during the compacting step.

SUMMARY OF THE INVENTION

To accomplish the foregoing and other objects, features and advantages of the invention, there is provided a method of making a radiography source of a radioactive material, described herein in a preferred embodiment in connection with the manufacture of a cobalt-60 radiographic source. This method comprises the steps of providing a plurality of radioactive pellets and furthermore providing an open capsule of a rigid metal having sufficient tensile strength to resist substantial deformation under pressure and selected from a group including elements of the periodic table displaced in density on the amount at least on the order of 2.0 gm/cc in comparison to the density of the radioactive pellet material. Generally speaking, this difference in density may also be expressed in terms of atomic number in which case the capsule is formed of an element displaced in atomic number by at least two from the atomic number of the radioactive pellet material. The radioactive pellets are disposed in the capsule and are compacted to reduce the source of focal spot size. A rigid metal plug is inserted in the open end of the capsule and the capsule is then welded closed. The compacting is provided by means of a ram that is dimensioned for close tolerance fit in the capsule. The pellets are compacted by inserting the ram into the capsule and applying a predetermined pressure to the ram. The pressure that is applied is a direct function of the area being compacted. In connection with this compacting step, there is also provided a die in which the capsule is disposed. The capsule is disposed in the die, which is preferably a split die, in a manner to hold the capsule so as to prevent any substantial deformation of the capsule due to pellet compaction. In accordance with the invention, the capsule, in a preferred embodiment, is constructed of titanium which has an atomic number of 22 in comparison to the cobalt atomic number of 27, and also has a density of 4.5 gm/cc in comparison to the aforementioned density of cobalt which is 8.9 gm/cc. In association with the pellets, there may also be provided one or more inserts of the same material as the capsule material. These inserts are disposed in the capsule after compacting the pellets and before inserting the plug.

In accordance with a further feature of the present invention there is provided a radiography source of a radioactive material which in the further embodiment is radioactive cobalt-60. This source comprises a plurality of radioactive pellets disposed in an open capsule. The capsule is of a rigid metal having sufficient tensile strength to resist substantial deformation under pressure and selected from a group including elements of the periodic table displaced in atomic number by at least two from the atomic number of the radioactive pellet material. The pellets are disposed in the capsule and compacted therein to reduce the source focal spot size. A plug is disposed in the open capsule and sealed therewith. The aforementioned capsule is then contained in an outer capsule that may be constructed of stainless steel. In accordance with the invention, the preferred construction of the inner capsule is of titanium as this material has an atomic number displaced by five from that of the radioactive material in the case of radioactive cobalt-60.

In accordance with still a further aspect of the present invention there is provided an improved press apparatus for providing pellet compaction and employed in the manufacture of a radiography source in which the source is of a radioactive material such as the aforementioned cobalt-60. The source includes a plurality of radioactive pellets contained in a capsule of a rigid metal having sufficient tensile strength to resist substantial deformation under pressure and selected from a group including elements of the periodic table displaced in atomic number by at least two from the atomic number of the radioactive pellet material. The press apparatus of the invention includes a ram means dimensioned from a close tolerance fit in the capsule and means for applying pressure for contacting the ram means, once positioned in the capsule. This latter means includes means for applying a predetemrined pressure to the ram means of an order of magnitude that is a direct function of the number of pellets to be compacted. The ram means preferably fits within the capsule with a close tolerance fit. The press means described herein includes a housing for supporting a press member. The press member preferably has a diameter greater than the diameter of the ram means and is supported so that the ram means progresses into the capsule during compaction without any cocking between the ram and the capsule. In this connection, there is provided a die having a hole therein for receiving the capsule. The die is preferably a split die comprised of separate die parts that can be opened and closed. The die parts are supported for sliding movement along a track from an initial position at which the die parts are opened for receipt of the capsule to a compacting position at which the die parts are locked closed during contact of the press member with the ram. The die, as well as the selected tensile strength of the capsule material together prevent any substantial deformation, particularly radial deformation of the capsule. The ram is preferably of cylindrical shape adapted to be disposed to about one-half its length into the capsule before pellet compaction and about three-fourths its length into the capsule after pellet compaction. The ram preferably has right angle corners at its bottom where the ram contacts the pellets.

BRIEF DESCRIPTION OF THE DRAWINGS

Numerous other objects, features and advantages of the invention should now become apparent upon a reading of the following detailed description taken in conjunction with the accompanying drawing, in which:

FIG. 1 is a cross-sectional view of a cobalt-60 radiography source in accordance with the prior art without pellet compaction;

FIG. 2 is a cross-sectional view of a cobalt-60 radiography source in accordance with the present invention in which there is pellet compaction;

FIG. 3 is a photographic rendition describing the two respective cases of FIGS. 1 and 2 without and with compaction;

FIG. 4 is a fragmentary cross-sectional view illustrative of an initial step in the fabrication of the radiography source of the present invention illustrating pellets loaded and the ram just installed;

FIG. 5 is a further cross-sectional view showing further details of the press apparatus and showing the die in its closed or clamped position with pressure being applied to the ram to cause pellet compaction;

FIG. 6 is a further cross-sectional view illustrative of a subsequent step in the manufacturing process illustrating removal of the ram and placement of spacers or inserts and the capsule plug;

FIG. 7 is a further cross-sectional view illustrating a subsequent step in the manufacturing process including the welding of the plug to the capsule;

FIG. 8 is a further cross-sectional view illustrating details of the outer capsule;

FIG. 9 is a cross-sectional view illustrating a further step in the process in which the outer capsule parts are welded together;

FIG. 10 is a perspective view illustrating the die halves of the press apparatus;

FIG. 11 is a side elevation view of the press apparatus with the die in an initial position wherein the capsule and ram, as illustrated in FIG. 4, are initially loaded into the die;

FIG. 12 is a plan view of the die apparatus of the present invention illustrating the die and capsule in its initial position; and FIG. 13 is a cross-sectional view taken along line 13—13 of FIG. 12 but illustrating the die halves slid forward and the ram being pressed for pellet compaction as previously illustrated in the cross-sectional view of FIG. 5.

DETAILED DESCRIPTION

In accordance with the present invention there is now described herein a radiographic source and associated method of fabrication thereof. The radiographic source is constructed of a radioactive material and is described herein, in a preferred embodiment, in connection with a cobalt-60 radiography source. The cobalt-60 radiography source, although, the principles of the invention may also be applied in connection with producing other radiography sources. In accordance with the present invention, there is now provided a technique for the tight compaction of cobalt-60 radioactive pellets into a minimal dimension for insertion into a preferred titanium capsule. The combination of the cobalt-60 pellets and the titanium capsule permit x-ray radiography to be used to verify the actual focal spot size that is developed, thus providing the customer of the source with verifiable evidence of the propsed focal spot size. In association with the technique of this invention, there is furthermore provided an improved press apparatus for carrying out effective cobalt-60 pellet compaction. It is to be noted that the titanium capsule provides the ability of x-ray analysis of the cobalt-60 source and is also of sufficient tensile strength so as to inhibit any substantial deformation thereof during compaction. Furthermore, the press apparatus of the present invention employed in the technique of manufacture described herein employs a preferred split die that is adapted to hold the capsule so as to prevent any substantial deformation of the capsule due to pellet compaction. In the past, capsule deformation was a problem because the inner capsule could not then be inserted into the outer capsule.

FIG. 1 illustrates a prior art cobalt-60 source including an inner capsule 10 and an outer capsule 12. Both these capsules are essentially of two-piece construction welded together. In this regard it is noted that the inner capsule 10 includes a plug 11 and the outer capsule 12 has an end member 13 that is adapted to couple to the cable or pigtail 14. The capsule assembly is attached to the pigtail by precision die swaging.

It is noted in the prior art view of FIG. 1 that within the capsule 10, there are provided a plurality of cobalt-60 radioactive pellets 16. It is noted that these pellets are loose in this embodiment and are not at all compact.

In connection with the prior art construction of FIG. 1, reference is also made to FIG. 3 in the x-ray photograph 1A. In this regard, it is noted that, because of no compaction, the focal spot size as indicated at 1B is relatively large. Compare this to the photograph at the bottom of FIG. 3 at 2A wherein the focal spot size indicated at 2B is small, as is desired.

FIG. 2 now illustrates a cobalt-60 radiography source as in accordance with the present invention. In FIG. 2 there is described the outer capsule 12 with its end 13 coupled to the pigtail 14. In FIG. 2 the capsule 20 is constructed of titanium. In the prior art version of FIG. 1, the capsule 10 is constructed of stainless steel. In FIG. 2 the capsule 20 is sealed by welding by a plug 21. FIG. 2 illustrates the compacted cobalt-60 pellets and furthermore illustrates a pair of spacers or insets 28. The spacers 28 and plug 21 are also constructed of titanium in the preferred embodiment described herein. Again, reference can be made at FIG. 3 at 2A for an x-ray photograph of the focal spot size of the radioactive source illustrated at 2B.

FIG. 4 is a cross-sectional view illustrating an initial step in the manufacture of a cobalt-60 radiography source. The capsule 20 is illustrated positioned in a split-die 32 that is comprised of die halves 33 and 34. It is noted that th capsule 20 has a semi-spherical bottom, but is generally of cylindrical cross-section. A plurality of radioactive pellet 26 are shown disposed within the capsule 20. FIG. 4 also illustrates the use of a ram 30. In FIG. 4, the ram 30 is shown in its very initial position before compaction and thus the pellets 26 are illustrated in their non-compacted position. The ram 30 may be constructed of a hardened steel. The pellets are of radioactive cobalt-60 and the capsule itself is constructed of titanium. The die halves 33 and 34 may be constructed of a rigid metal such as steel. In connection with these die halves, also refer to the perspective view of FIG. 10 for an illustration of these members. Note in FIG. 10 the part cylindrical cavity at 35 disposed in facing surfaces of each of the respective die halves 33 and 34. The capsule is adapted to fit in the die, when the die is in its closed position with a very close tolerance fit.

As far as the ram 30 is concerned, as indicated previously, this is constructed of a hardened steel. It is adapted to be used informing one source and then discarded. The ram 30 also is dimensioned to have a close tolerance fit within the capsule.

It is to be noted that in connection with the fabrication of a radioactive source in accordance with the present invention, this is carried out in a "hot cell" with the use of mechanical manipulators. Because one is dealing with radioactive material, the fabrication of the source has to be carried out in a safe environment so that the worker is not exposed to any radioactive material.

After the pellets 26 have been inserted into the capsule and the ram 30 is disposed in position, then the next step is illustrated in FIG. 5 in which pressure is applied to the ram 30 by means of the press apparatus of the present invention, to be described in further detail hereinafter in connection with FIGS. 11–13. This press apparatus includes a press member 36 that is adapted to move in the direction of arrow 37 illustrated in FIG. 5. It is noted that the diameter of the press member 36 is substantially greater than the diameter of the ram 30. The press member 36 is disposed so that it moves accurately in a vertical direction against the top of the ram 30 without providing any skewing or cocking of the ram 30 relative to the capsule 20. during this operation, the die halves 33 and 34 are closed by means of the locking member 45 that includes a handle 43 as well as a locking screw 44, all illustrated in the view of FIG. 5. The locking screw 44 urges the die halves 33 and 34 into contact retaining the capsule 20 in position therebetween as illustrated in FIG. 5. The capsule 20 is not necessarily securely clamped by the die halves, but when the die halves are in their closed locked position, the capsule 20 is adapted to have only a slight clearance all around clearance all around. Thus, if there is any deformation of the capsule by virtue of this compaction with the press member 36 and ram 30, the closed die halves prevent any substantial deformation of the capsule, particularly in a radial direction. As can be seen from FIGS. 8 and 9, the inner capsule 20 fits with a relatively close tolerance fit in the outer capsule 12 and thus it is desired that little or no deformation occur to the capsule 20 during this compaction step.

After the radioactive cobalt-60 pellets 26 are compacted, the ram 30 is removed from the capsule. This is illustrated schematically in FIG. 6. It may be necessary to gently tap the ram on the side with a short length of stainless steel bar to assist in removal of the ram. It is noted that the ram 30 is of generally cylindrical design and has entirely flat right angle ends. This is particularly important at the end contacting the pellets so that the pellets are compacted evenly throughout the capsule.

FIG. 6 also shows the plug 21. This is preferably constructed of titanium also. Also illustrated in FIG. 6 are two titanium spacers or inserts 28. These spacers are optionally used in the event that the plug does not totally fill the space above the compacted pellets. Refer also to the spaces or inserts illustrated in FIG. 2.

Reference is now made to FIG. 7 for a subsequent step in the operation. It is to be understood that these various steps are carried out in a "hot cell" with the use of mechanical manipulators. FIG. 7 shows the capsule 20 with the plug 21 and inserts 28 inserted therein, having been moved now to a weld station where the capsule 20 is disposed in a weld head 38. FIG. 7 shows the welding tip 40 disposed in position to provide a weld between the capsule 20 and plug 21 about the periphery of the plug 21. As indicated by the arrow 39 in FIG. 7, the weld head 38 is adapted to be rotated while the welding tip 40 is maintained stationary. A tungsten inert gas weld apparatus is preferably used for this purpose.

Once the welding step is completed, then with reference to FIG. 8, the inner capsule 20 is inserted into the outer capsule 12 and the end 13 is engaged with the capsule 12. FIG. 9 shows the next step in which the outer capsule 12 is now also inserted into a weld head 38. FIG. 9 also shows the weld tip 40. The weld head 38 rotates as previously discussed and the weld tip 40 remains stationary. FIG. 9 illustrates the weld between the different parts of the outer capsule. As indicated previously, it is noted that the inner capsule 20 fits within the outer capsule 12 with a relatively close tolerance fit. The outer capsule 12 including its end 13 is preferably constructed of stainless steel. The pigtail 14 is then inserted into the hollow in end 13 and it is swaged therein. This is not illustrated in FIG. 9, but is shown in the previous cross-sectional view of FIG. 2.

Reference is now made to FIGS. 10–13 for further details of the press apparatus that is used in providing compacting of the radioactive cobalt-60 pellets. FIG. 10 illustrates the die halves 33 and 34 with the cavity 35 in respective halves forming the pocket for retaining the capsule 20. The die 32 is adapted to slide on a track 48 as illustrated most clearly in FIG. 12. In the initial position thereof as illustrated in FIGS. 11 and 12, the die is in its open position. FIG. 12 shows the die halves mated, but they are not yet locked and in this position there is sufficient clearance so that the die halves can be easily separated by a small amount to enable ready insertion of the capsule 20. As has been indicated previously, even when the die halves are locked together, there still may be a slight clearance between the capsule and the die halves.

The press apparatus of the present invention is preferably a hydraulic press system in which the pressure applied by the press member 36 is controlled so that the proper predetermined pressure is applied. This pressure is a function of the pellets and the cross sectional area of the capsule. The larger the capacity of the radioactive source, of course, the larger the number of pellets that are used. Also, the capsule will vary in diameter and length depending upon the capacity and source that is to be fabricated so as to accommodate these different numbers of pellets.

The hydraulic press apparatus includes a housing 50 that supports a hydraulic press 52. A housing 50 supports the aforementioned track 48 and furthermore supports the clamping member 45 previously discussed with regard to FIG. 5. This member also includes the handle 43 that is used to tighten the screw 44 against the die 32.

FIGS. 11 and 12 have illustrated the die 32 at its initial position referred to as its open position. Once the capsule 20 has been inserted into the die, then the die is moved along the track 48 to a position as illustrated in FIG. 13. The die 32 is then in a position wherein the die halves are closed and locked as illustrated in FIG. 5. The press member 36 is in vertical alignment with the ram 30 as illustrated in FIGS. 5 and 13. Note in FIG. 13 that the member 36 is actually comprised of a chuck 56 and threaded cylinder 58. The cylinder 58 contacts the ram 30 as illustrated in FIG. 13. Pressure is applied to the ram 30 by means of the press member 36. There is a direct function between the pressure applied and the size and activity of the source. The pressure applied increases as a direct function of the area of the capsule but the relationship is not linear.

With respect to the hydraulic press apparatus, it is noted that the press member 36 is preferably of a diameter substantially larger than the diameter of the ram. Furthermore, the press apparatus is constructed so that it provides an accurate force of a controlled characteristic without providing any cocking of the ram 30. The press member 36, in particular, in combination with the die provides an effective and accurate alignment technique. The die itself captures at least half of the depth of the capsule and preferably two-thirds or more thereof and thus the capsule is maintained in a steady position. The hydraulic press is furthermore constructed to provide accurate vertical pressure by the press member 36 against the ram 30.

The ram 30 is preferably constructed of a length that is neither too short nor too long. If the ram is too long then there is apt to be some misalignment with the capsule 20 and possibly some cocking of the ram relative to the capsule. If the ram is too short then there may be compaction of the capsule by contact with the top surface thereof which is not desired. This would cause deformation of the capsule at the top end thereof. The ram 30 is preferably of a length so that initially before compaction, as illustrated in FIG. 4, the ram extends into the capsule by an amount equal to approximately half the length of the ram. After compaction, the ram is disposed in the capsule, such as illustrated in FIG. 5, so that on the order of two-thirds to three-fourths of the ram is now disposed in the capsule.

In summary, in accordance with the present invention there is now provided an improved radiography source and, in particular, an improved cobalt-60 radiography source in which the improvements to the source construction relate to, not only the materials employed but also improvements in the construction method. This includes the tight compaction or compression of the cobalt-60 radioactive pellets into minimal dimensions in combination with the use of a preferred titanium capsule which permits x-ray radiography to be used to verify the actual focal spot size developed thus providing the user with verifiable evidence of the stated focal spot size. The cobalt-60 source and the titanium capsule are sufficiently different in atomic number and density to allow good resolution by X-ray radiography. It is to be noted that this focal spot size verification preferably occurs after the inner capsule has been sealed in the outer capsule. Once again, FIG. 3 illustrates the X-ray radiograph for identifying focal spot size.

In accordance with the present invention, the principles described herein may also be employed in the construction of other types of radiography sources. To obtain proper resolution by X-ray radiography, it has been found that the capsule material is to be selected from a group including elements from the periodic table displaced in density by at least 2.0 gm/cc from that of the radioactive pellet material. In this connection, and with regard to the previous density stated, it is noted that the cobalt and stainless steel are only displaced in density by 1.0 gm/cc. This is not sufficient. However, note that the cobalt and titanium are displaced in density by approximately 4.4 gm/cc. This displacement should be at least on the order of 2.0 gm/cc as previously stated.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. A method of making a radiography source of a radioactive material, said method comprising the steps of;

providing a plurality of radioactive pellets, providing an open capsule of a rigid metal having sufficient tensile strength to resist substantial deformation under pressure and selected from a group including elements of the periodic table displaced in density by an amount at least on the order of 2.0 gm/cc from the density of the radioactive pellet material, sufficient to be resolvable by X-ray radiography, disposing the radioactive pellets in said capsule, compacting the radioactive pellets to reduce source focal size, providing a rigid metal plug, inserting the plug in the open capsule, and welding the plug to said capsule.

2. A method as set forth in claim 1 wherein the compacting step comprises, providing a ram dimensioned for close tolerance fit in said capsule, and compacting the pellets by inserting the ram into the capsule and applying predetermined pressure to the ram.

3. A method as set forth in claim 2 wherein said predetermined pressure is a direct function of the area of pellets to be compacted.

4. A method as set forth in claim 3 including providing a die and disposing the capsule in the die for subsequent compaction of pellets.

5. A method as set forth in claim 4 wherein the capsule is disposed in the die in a manner to hold the capsule so as to prevent any substantial deformation of the capsule due to pellet compaction.

6. A method as set forth in claim 5 wherein the die is provided as a split die including die halves that are closed to retain the capsule.

7. A method as set forth in claim 1 including constructing said capsule of titanium.

8. A method as set forth in claim 7 including constructing said plug of titanium.

9. A method as set forth in claim 1 including providing at least one insert of the same material as said capsule and disposing the insert in the capsule after compacting the pellets and before inserting the plug.

10. A method as set forth in claim 9 including constructing the capsule, plug and insert all of titanium.

11. A method as set forth in claim 1 including providing a cobalt-60 source and providing a capsule of a tensile strength greater than on the order of 45,000 p.s.i.

12. A radiography source of a radioactive material, said source comprising, a plurality of radioactive pellets, an open capsule of a rigid metal having sufficient tensile strength to resist substantial deformation under pressure and selected from a group including elements of the periodic table displaced in density by an amount at least on the order of 2.0 gm/cc from the density of the radioactive pellet material, sufficient to be resolvable by X-ray radiography, said pellets being disposed in said capsule and compacted therein to reduce the source focal size, and a plug disposed in the open capsule and sealed therewith.

13. A radiography source as set forth in claim 12 wherein said predetermined pressure is a direct function of the cross-sectional area of pellets to be compacted.

14. A radiography source as set forth in claim 12 wherein said capsule is constructed of titanium.

15. A radiography source as set forth in claim 14 wherein said plug is constructed of titanium.

16. A radiography source as set forth in claim 12 including at least one insert of the same material as said capsule, said insert disposed in the capsule.

17. A radiography source as set forth in claim 16 wherein said capsule, plug and insert are all constructed of titanium.

18. A radiography source as set forth in claim 12 wherein said pellets comprise cobalt-60 pellets and said capsule has a tensile strength greater than on the order of 45,000 p.s.i.

* * * * *